US005955845A

United States Patent [19]

Fellows

[11] Patent Number: 5,955,845

[45] Date of Patent: Sep. 21, 1999

[54] HIGH PRESSURE SERIES ARC DISCHARGE LAMP CONSTRUCTION WITH SIMPLIFIED STARTING AID

[75] Inventor: Mark W. Fellows, Hammondsport, N.Y.

[73] Assignee: Philips Electronics North America Corporation, New York, N.Y.

[21] Appl. No.: 08/831,260

[22] Filed: Apr. 7, 1997

Related U.S. Application Data

[63] Continuation-in-part of application No. 08/694,056, Aug. 8, 1996, Pat. No. 5,661,367.

[51] Int. Cl.[6] ..... H05B 37/00

[52] U.S. Cl. ..... 315/189; 315/185 R; 315/324; 313/596; 313/286

[58] Field of Search ..... 315/189, 185 R, 315/179, 59, 324; 313/596, 603, 285, 286

[56] References Cited

U.S. PATENT DOCUMENTS

| | | | |
|---|---|---|---|
| 4,751,432 | 6/1988 | Van Delm | 315/178 |
| 5,028,845 | 7/1991 | Ravi et al. | 315/189 |
| 5,424,609 | 6/1995 | Geven et al. | 313/623 |
| 5,541,480 | 7/1996 | Renardus et al. | 313/635 |

*Primary Examiner*—Don Wong
*Assistant Examiner*—Haissa Philogene
*Attorney, Agent, or Firm*—Walter M. Egbert

[57] ABSTRACT

A high pressure sodium discharge lamp includes first and second discharge devices electrically connected in series within an outer envelope. The discharge devices each include a discharge vessel enclosing a discharge space with an ionizable fill and first and second discharge electrode assemblies. The first discharge electrode assemblies of the discharge devices are connected so as to receive a starting pulse and lamp operating voltage. Each discharge vessel includes a first wall portion spaced from the first discharge electrode assembly and defining an ionizable gap therebetween. A conductive element bridges the discharge devices at the first wall portions and capacitively couples the first discharge electrode assemblies to induce ionization in one of the discharge devices in the ionizable gap between the first wall portion and first discharge electrode assembly.

3 Claims, 3 Drawing Sheets

HIGH PRESSURE SERIES ARC DISCHARGE LAMP CONSTRUCTION WITH SIMPLIFIED STARTING AID

CROSS-REFERENCE TO RELATED APPLICATION

This application is a continuation-in-part of Ser. No. 08/694,056 filed Aug. 8, 1996, now U.S. Pat. No. 5,661,367.

BACKGROUND OF THE INVENTION

The invention relates to a high pressure discharge lamp with first and second discharge devices connected electrically in series within an outer bulb, each discharge device including a discharge vessel enclosing a discharge space and an ionizable filling, first and second discharge electrode assemblies within the discharge space each including an electrode portion on which a discharge terminates during normal lamp operation and a current conductor portion extending to the exterior of the discharge vessel, and means for electrically connecting the first electrode assembly of each discharge device to a source of electric potential outside of the lamp envelope, and a starting aid facilitating ignition of the discharge devices.

Such a lamp is known from U.S. Pat. No. 4,751,432 (Van Delm). High pressure discharge lamps may have series connected discharge devices included within a single lamp envelope to decrease the overall size of the lamp or to achieve a blended light. Lumen output and consumed power of a high pressure discharge device are proportional to the physical separation between the discharge electrodes and consequently the overall length of the discharge device. Lamps rated at high power with a single arc tube therefore have a large overall length, which is generally undesirable from the optical as well as cost and handling standpoints. The overall length of the lamp can be significantly reduced, for example, by arranging two discharge devices within an outer envelope each operated at half the total desired power. Two discharge devices emitting different spectrums have also been employed to achieve an improved blended spectrum different from either device alone.

A high pressure arc discharge device is ignited by providing a starting pulse across the discharge electrodes with a prescribed voltage and bandwidth. This is typically accomplished with an external ignitor in a ballast contained in a lighting fixture. The ignition pulse(s) are applied through the lamp cap, usually in the form of a threaded base. Reliable ignition of such discharge lamps is frequently a problem, as the multiple discharge devices affect the starting characteristics of each other, generally requiring a starting pulse of much higher energy than that which reliably starts one discharge device of the same total wattage. However, safety constraints place an upper limit on the voltage of the ignition pulse applied through the lamp cap. Furthermore, commercial viability does not permit a lamp designer to market a lamp which requires its own special ballast and/or ignitor. Rather, HID lamps with multiple discharge devices rated at a certain total wattage are operated with existing ballasts designed to operate a lamp with a single discharge device of corresponding rated wattage.

The above-mentioned patent discloses a starting aid which sequentially starts the two discharge devices. The starting aid is a bi-metal switch which shorts one of the discharge devices to permit the ignition pulse to be applied initially across one device only. After the one device ignites and supports an arc discharge, the heat therefrom causes the bi-metal switch to open. This permits the ignition pulse to be applied across both the first and second discharge devices. Since the impedance across the already-burning discharge device is low, the second discharge device sees essentially the entire energy of the ignition pulse, providing reliable starting. One disadvantage of this construction is the long delay in igniting the second discharge device due to the time it takes for the first discharge device to heat the bimetal to its opening temperature, on the order of about 1–2 min. Additionally, bi-metal switches are cumbersome to install, usually requiring hand-mounting and/or adjustment

SUMMARY OF THE INVENTION

Accordingly, it is an object of the invention to provide a simplified starting aid for two discharge devices connected in series. This object is accomplished in that a lamp of the type described in the opening paragraph is characterized in that said starting aid comprises (i) each of said discharge vessels includes a first wall portion spaced from said first discharge electrode assembly and defining an ionizable gap therebetween and (ii) a conductive bridging element bridging said first wall portions, said conductive element being spaced from each of said first discharge electrode assemblies and said ionizable gap being selected such that upon application of a predetermined starting pulse across said first discharge electrode assemblies said conductive element capacitively couples said first discharge electrode assemblies to each other and induces ionization of said ionizable filling in said ionizable gap between said first discharge electrode assembly and said first wall portion of one of said discharge devices.

According to a favorable embodiment of the invention, the discharge vessels are ceramic Much tighter tolerance in the spacing between the electrode assembly and the adjacent wall are also possible with a ceramic rather than quartz glass discharge vessel. In one embodiment, the conductive element has a maximum spacing from the discharge electrodes of about 0.9 mm.

A simple, low cost construction is obtained when the conductive element consists of a length of conductive metal, such as wire or sheet strip, having end portions engaging each first wall portion of the discharge devices. Favorably, the conductive element has end portions each bent around a respective first wall portion to mechanically secure the conductive element to each discharge device. In this way, no additional fastening elements are required.

These and other aspects, features and advantages of the invention will become apparent with reference to the drawings and the following detailed description.

DESCRIPTION OF THE PREFERRED EMBODIMENTS

Figure 1:
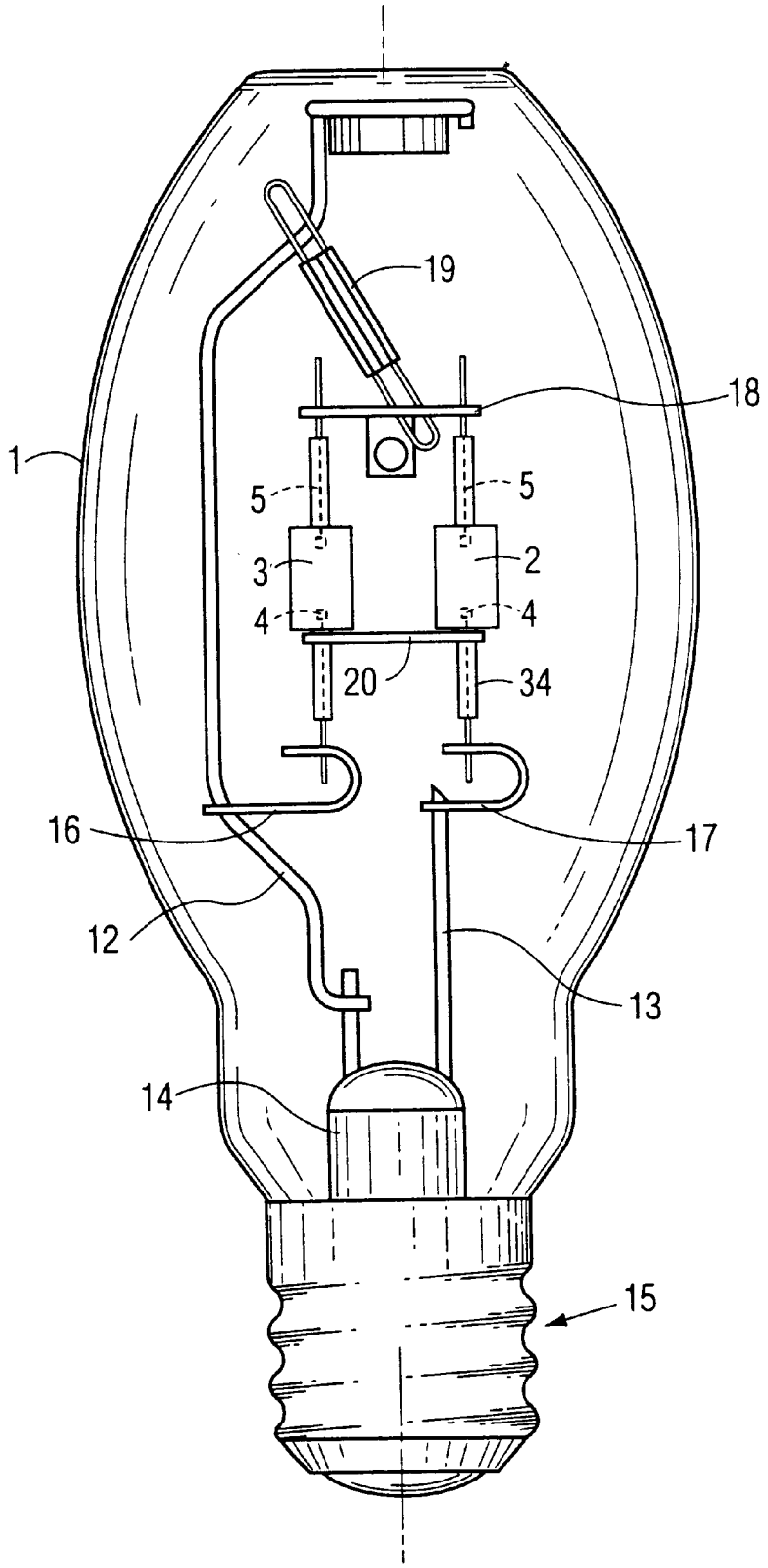
FIG. 1 is a side view of a high pressure discharge lamp having a pair of discharge devices electrically connected in series and having a conductive bridging element.
Figure 2A:
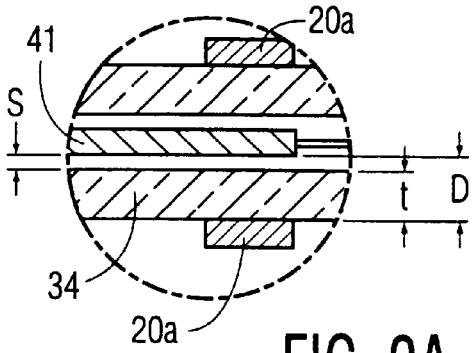
FIGS. 2(A,B) is a cross section of the arc tube illustrating an ionization gap between the electrode assembly and the bridging element.
Figure 2B:
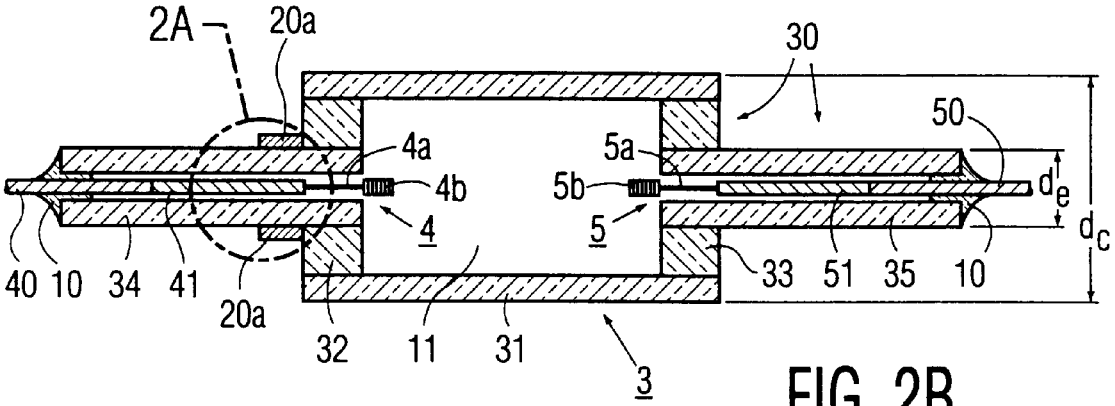

FIG. 1 shows a metal halide high pressure discharge lamp with first and second discharge devices 2, 3 connected electrically in series within an outer bulb, or lamp envelope, 1. The discharge devices are nominally identical. FIG. 2 further illustrates the discharge device 3, which includes a discharge vessel 30 enclosing a discharge space 11 and containing an ionizable filling of mercury, a metal halide and a rare gas. Discharge vessel 30 has a circular cylindrical wall 31 with end walls 32, 33 which together define a central zone of the discharge vessel. Circular cylindrical walls 34, 35 define first and second end zones which communicate with the central zone and enclose respective first and second discharge electrode assemblies 4, 5. Each end zone has a largest external diameter "$d_e$" smaller than the smallest external diameter "$d_c$" of the central zone. The walls 31–35 are ceramic. As used herein, "ceramic" means a refractory material such as monocrystalline metal oxide (for example, sapphire), polycrystalline metal oxide (for example, polycrystalline densely sintered aluminium oxide; yttrium-aluminium garnet, or yttrium oxide), and polycrystalline non-oxidic material (for example, aluminium nitride). Such materials allow for high wall temperatures up to 1500–1600 K and are satisfactorily resistant to chemical attacks by halides and by Na.

Each discharge electrode assembly 4,5 includes (i) an electrode portion with an electrode rod 4*a*, 5*a* and a winding 4*b*, 5*b* on which a discharge terminates during normal lamp operation and (ii) a current conductor portion extending to the exterior of the discharge vessel Each current conductor portion includes a first, halide resistant portion 41, 51 made of, for example, molybdenum, and a second portion 40, 50 which is sealed in a gas-tight manner to the respective wall 34, 35 with a ceramic frit 10. The second portions 40, 50 are of a conductive material which has a coefficient of thermal expansion which is close to that of the ceramic wall, for example niobium. The discharge device is further described in U.S. Pat. No. 5,424,609.

A conductive frame supports the discharge devices within the outer lamp envelope. (FIG. 1) The frame includes first and second conductive support rods 12, 13 extending from the lamp stem 14, each connected to a respective lamp contact on the lamp base 15 in a known manner. Respective C-shaped connectors 16, 17 electrically connect each of the first electrode assemblies 4 to a respective first and second support rod 12, 13, and consequently to a source of electric potential provided at the contacts at the lamp base 15. The second electrode assemblies 5 are connected in series via conductive cross member 18. An insulative support 19 is connected between the cross member 18 and the upper end of the support rod 12 to provide further mechanical support to the discharge vessels.

Figure 3:
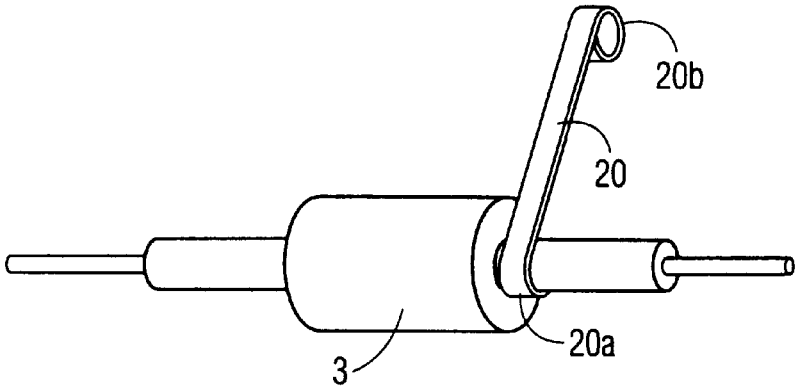
FIG. 3 is a perspective view of the bridging element and one discharge device.

A conductive bridging element 20 in the form of a planar metallic strap bridges the two discharge devices surrounding the electrode assemblies 4. As shown in FIG. 3, the strap has opposing end portions 20*a*, 20*b* each bent around a respective first end zone to mechanically secure the strap to the discharge devices in a simple manner. In the embodiment shown, the resulting looped end portions were welded together and the straps stayed fixed on the end portions. Alternatively, the strap could be made of a memory metal which retains its shape to hold the strap on the discharge devices despite the large difference in temperature between the "on" and "off" state of the lamp.

As shown in FIGS. 2 and 3, the strap lies against the wall 34 of each discharge vessel in the first end zone at the area immediately adjacent the end walls 32. In this area, the electrode assembly, in particular the halide resistant portion 41, is spaced from the inner surface of this wall portion by a distance "S". Since the end zone communicates with the central zone, the ionizable fill is present in the space between the electrode assembly and the wall forming an ionizable gap therebetween. The wall has a thickness "t", so the strap is spaced from the electrode assembly by a total distance D=S+t. The distance D is selected such that upon application of a predetermined starting pulse across the first discharge electrode assemblies 4 (via base 15 and conductive supports 12, 13) the conductive element 20 capacitively couples the first discharge electrode assemblies 4 to each other and induces ionization in the ionizable gap of one of the discharge devices. The ionization provides protons to ensure initial electron emission from the electrode. This leads to further breakdown of the ionizable fill, proceeding to a gas discharge being maintained between the discharge electrodes of that discharge device. Once a gas discharge is supported, the impedance of that discharge device is drastically reduced so that the other discharge device sees substantially the entire energy of subsequent starting pulses. Consequently, the discharge devices start sequentially and reliably.

The predetermined starting pulse for which a lamp is designed will vary depending on lamp wattage and type. The starting pulse is limited in magnitude by the maximum voltage which the lamp cap and frame can take without arcing. The starting pulse is also typically limited to that which is supplied by commercially available ignitor\ballasts with which the lamp will be used.

In a practical embodiment, the discharge vessel walls were made from polycrystalline densely sintered aluminum oxide. The electrode rods, winding were made of tungsten and free from emitter. Each discharge device had a rated power of 100 W. The filling of the discharge vessel was 6.7 mg Hg and 7 mg of the metal halides sodium iodide/thalium iodide/dysprosium iodide in a weight ratio 91:8:1, and argon as a starter gas at 200 Torr cold pressure. Each discharge vessel had an internal diameter of 7.2 mm and an internal length of 10 mm. The width S of the ionizable gap was 35 $\mu$m and the wall thickness t of wall 34 was 850 $\mu$m, providing a total distance D between the electrode assembly and the conductive bridging element of about 0.9 mm.

A comparison test was conducted between six of the above described lamps and ten otherwise identical lamps without the conductive strap 20. The lamps were operated in a dark environment on an ADVANCE® 100 W metal halide ballast with the ballast ignitor replaced with the standard ANSI pulse generator circuit (Velonix 350 High Voltage Pulse Generator or Equivalent) according to the ANSI standard: C78.387-1995 for metal halide lamps. The pulse width was 1 $\mu$s, and the pulse was increased in amplitude until the lamp started. The ANSI specified maximum is 4000 V for the pulse amplitude. All lamps with the conductive strap started in the voltage range of 2400 to 2800 V, with the average being 2600 V. Lamps without the starting aid would only randomly light, in all cases above 3500 V and typically not below the ANSI specified maximum of 4000 V.

Figure 4:
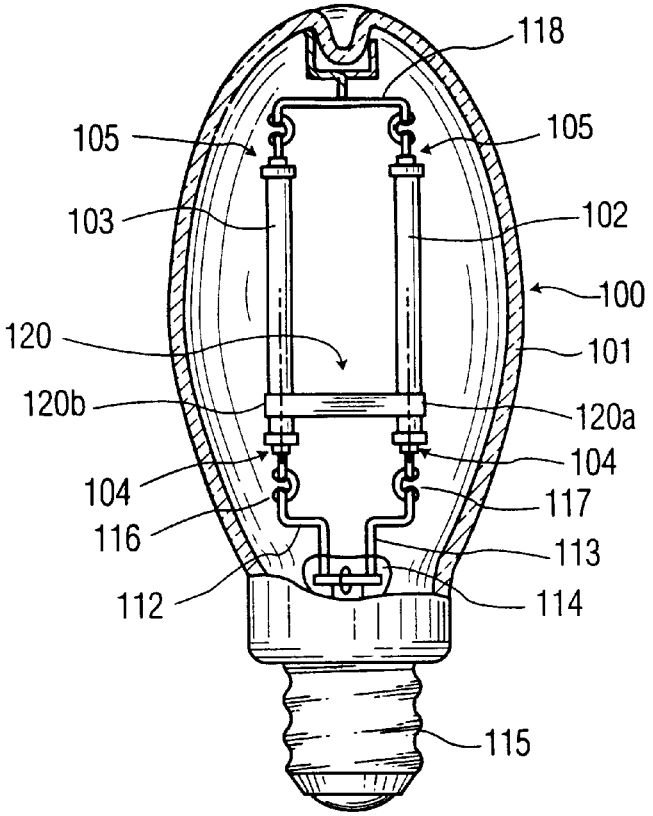
FIG. 4 is a side view of an alternative embodiment of a high pressure discharge lamp having a pair of discharge devices electrically connected in series and having a conductive bridging element.
Figure 5:
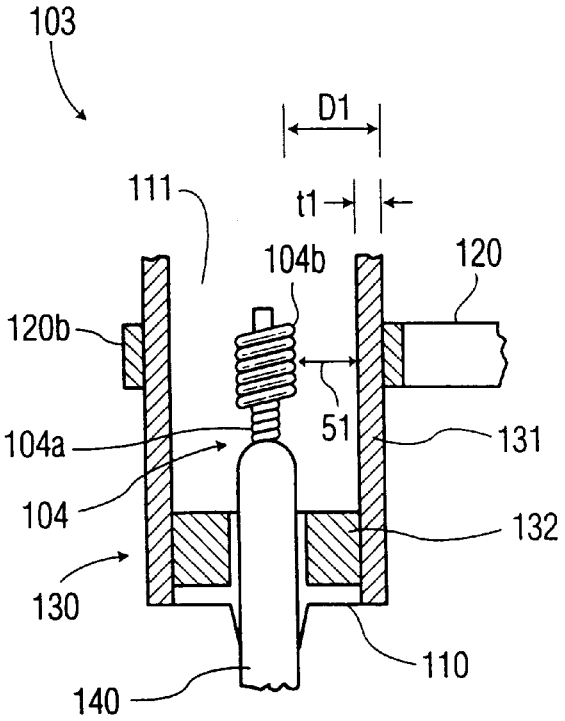
FIG. 5 is a cross section of an end portion of the arc tube illustrating an ionization gap between the electrode assembly and the bridging element.

Six lamps with UV enhancers ignited at, on average, 2600 V as above. Thus, the results with the conductive straps and the UV enhancers were equivalent FIGS. 4–5 illustrate another preferred embodiment of the subject invention As shown in FIG. 4, high pressure sodium lamp 100 has first and second discharge devices 102, 103 connected electrically in series within an outer bulb, or lamp envelope, 101. The discharge devices 102, 103 are nominally identical. The high pressure sodium lamp is substantially described in U.S. Pat. No. 5,028,845 to Ravi et al., incorporated by reference herein, with the differences noted hereinbelow. FIG. 5 further illustrates an end portion of the discharge device 103 adjacent the lamp base 115, which includes a discharge vessel 130 enclosing a discharge space 111 and containing an ionizable filling, such as a sodium-mercury amalgam, which is partially vaporized when the lamp reaches an operating temperature Discharge vessel 130 has a circular cylindrical wall 131 with end wall 132. The walls 131–132 are ceramic as described hereinabove with repsect to ceramic walls 31–35. The end portion of discharge device 102 is substantially identical as that known for discharge device 103.

Each discharge electrode assembly 104 includes (i) an electrode portion with an electrode rod and a winding 104*b* on which a discharge terminates during normal lamp operation and (ii) a current conductor portion 140 which is sealed in a gas-tight manner to the respective wall 132 with a ceramic frit 110. The current conductor portions 140 are of a conductive material which has a coefficient of thermal expansion which is close to that of the ceramic wall, for example niobium. Electrode assembly 105 is substantially identical to electrode assembly 104 as shown in FIG. 5.

With continued reference to FIG. 4, a conductive frame supports the discharge devices within the outer lamp envelope. The frame includes first and second conductive support rods 112, 113 extending from the insulating lamp stem 114, each connected to a respective lamp contact on the lamp base 115 in a known manner. Respective C-shaped connectors 116, 117 electrically connect each of the first electrode assemblies 104 to a respective first and second support rod 112, 113, and consequently to a source of electric potential provided at the contacts at the lamp base 115. The second electrode assemblies 105 are connected in series via conductive cross member 118.

A conductive bridging element 120 in the form of a planar metallic strap bridges the two discharge devices surrounding discharge 102 and 103 adjacent the electrode assemblies 104. As shown in FIG. 5, the strap has opposing end portions 120*a*, 120*b* each bent around a respective discharge vessel to mechanically secure the strap to the discharge devices in a simple manner. In the embodiment shown, the resulting looped end portions were welded together and the straps stayed fixed on the end portions. Alternatively, the strap could be made of a shape memory metal which retains its shape to hold the strap on the discharge devices despite the large difference in temperature between the "on" and "off" state of the lamp. In yet another alternative embodiment, a tungsten antenna wire may be fired into the ceramic wall 131, as disclosed in U.S. Pat. No. 5,541,480, to Renardus et al. The end portions 120*a*, 120*b* may be attached in contact with the antenna wire adjacent the electrode tip 104*b*.

As shown in FIGS. 4 and 5, the strap lies against the wall 134 of each discharge vessel in the first end zone at the area adjacent the electrode tips. In this area, the electrode assembly is spaced from the inner surface of this wall portion by a distance "S1", defining an ionizable gap therebetween. The wall has a thickness "t1", so the strap is spaced from the electrode assembly by a total distance D1=S1+t1. The distance D1 is selected such that upon application of a predetermined starting pulse across the first discharge electrode assemblies 104 (via base 115 and conductive supports 112, 113) the conductive element 120 capacitively couples the first discharge electrode assemblies 104 to each other and induces ionization in the ionizable gap of one of the discharge devices. The ionization provides protons to ensure initial electron emission from the electrode This leads to further breakdown of the ionizable fill, proceeding to a gas discharge being maintained between the discharge electrodes of that discharge device. Once a gas discharge is supported, the impedance of that discharge device is drastically reduced so that the other discharge device sees substantially the entire energy of subsequent starting pulses. Consequently, the discharge devices start sequentially and reliably.

While there has been shown to be what is considered by the inventors to be the preferred embodiment of the invention, those of ordinary skill in the art will appreciate that various modifications may be made to the above described lamp which are within the scope of the appended claims. Accordingly, the specification is considered to be illustrative only and not limiting.

What is claimed is:

1. A high pressure sodium lamp comprising:

an outer bulb;

first and second discharge devices within said outer bulb connected electrically in series, each discharge device including a discharge vessel enclosing a discharge space and an ionizable filling;

first and second discharge electrode assemblies within said discharge space each including an electrode portion on which a discharge arc terminates during normal lamp operation and a current conductor portion extending to the exterior of said discharge vessel;

means for electrically connecting said first electrode assembly of each discharge device to a source of electric potential outside of said lamp envelope; and an ignition aid within said outer bulb facilitating ignition of said discharge devices upon application of a starting pulse to said discharge lamp, characterized in that:

said starting aid comprises (i) each of said discharge vessels includes a first wall portion spaced from said first discharge electrode assembly and defining an ionizable gap therebetween and (ii) a conductive element bridging said first wall portions, said conductive element being spaced from each of said first discharge electrode assemblies and said ionizable gap being selected such that upon application of a predetermined starting pulse across said first discharge electrode assemblies said conductive element capacitively couples said first discharge electrode assemblies to each other and induces ionization of said ionizable filling in said ionizable gap between said first discharge electrode assembly and said first wall portion of one of said discharge devices.

2. A high pressure discharge lamp according to claim 1, characterized in that said conductive element consists of a length of planar metal strap having end portions engaging said first wall portion of each discharge vessel.

3. A high pressure discharge lamp according to claim 3, wherein said length of planar metal strap is bent around each of said cylindrical wall portions to mechanically secure said strap to said discharge devices.

* * * * *